US011737573B2

(12) United States Patent
Lee

(10) Patent No.: US 11,737,573 B2
(45) Date of Patent: Aug. 29, 2023

(54) BLANKET SUSPENDER ASSEMBLY

(71) Applicant: Lawrence Lee, Beaverton, OR (US)

(72) Inventor: Lawrence Lee, Beaverton, OR (US)

( * ) Notice: Subject to any disclaimer, the term of this patent is extended or adjusted under 35 U.S.C. 154(b) by 93 days.

(21) Appl. No.: 17/565,553

(22) Filed: Dec. 30, 2021

(65) Prior Publication Data

US 2023/0210270 A1 Jul. 6, 2023

(51) Int. Cl.
*A47C 21/02* (2006.01)
*A41F 19/00* (2006.01)

(52) U.S. Cl.
CPC ..... *A47C 21/024* (2013.01); *A41F 19/00* (2013.01)

(58) Field of Classification Search
CPC ..... A47C 21/024; A41F 19/00
See application file for complete search history.

(56) References Cited

U.S. PATENT DOCUMENTS 4,389,744 A * 6/1983 Monroe ..... A47G 9/02 5/498
5,441,789 A 8/1995 Walker
6,026,516 A * 2/2000 Dacyshyn ..... A41F 3/02 2/323
6,308,335 B1 * 10/2001 Colorado ..... A41D 13/0007 2/81
D745,791 S 12/2015 Corley
9,439,463 B1 9/2016 Spears
10,602,783 B1 3/2020 Colligan
2003/0213046 A1 * 11/2003 Lewis ..... A41F 3/00 2/79
2004/0088775 A1 5/2004 Fortuna
2008/0235870 A1 10/2008 Heide
2010/0275345 A1 * 11/2010 Dudenhoeffer ..... A41F 3/00 2/326
2011/0083254 A1 * 4/2011 Trutna ..... A41F 3/02 2/326
2012/0060285 A1 * 3/2012 Herman ..... A47C 21/022 5/498
2013/0198939 A1 * 8/2013 Herman ..... A41F 3/00 2/327
2013/0247282 A1 * 9/2013 Herman ..... A41F 11/00 2/327
2015/0338193 A1 11/2015 Walker
2017/0215559 A1 * 8/2017 Ciptak ..... A45F 3/04
2019/0059464 A1 2/2019 Hoebee

* cited by examiner

*Primary Examiner* — David M Upchurch

(57) ABSTRACT

A blanket suspender assembly for suspending a blanket around pants of a user includes a blanket and a suspender. A strip is coupled along a full length of a top edge of the blanket. The strip is a first portion of a hook and loop fastener. The suspender comprises of a pair of straps. Each strap of the pair of straps has a front hinge and a back hinge. The suspender is placed on the shoulders of a user where the front fringe of each strap is positioned in front of the user and the back fringe of each strap is positioned behind the user. A plurality of tabs is coupled to a respective one of each front hinge and each back hinge. Each of the tabs is the second portion of the hook and loop fastener. Each of the tabs engages by hook and loop fastening with the strip.

8 Claims, 6 Drawing Sheets

BLANKET SUSPENDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR Not Applicable

BACKGROUND OF THE INVENTION

(1) Field of the Invention

The disclosure relates to blanket securing systems and more particularly pertains to a new blanket securing system for suspending a blanket around pants of a user with adjustable straps.

(2) Description of Related Art Including Information Disclosed Under 37 CFR 1.97 and 1.98

The prior art relates to blanket securing systems. The prior art discloses a variety of blanket securing systems having blankets configured for enwrapping the torso of a user, including the arms, back, and head of the user. Furthermore, the prior art relates to a variety of blanket securing systems comprising of a plurality of straps having a fixed length. There is no mentioning of a blanket securing system comprising of adjustable straps engaging to a blanket wherein the blanket is winding around the pants of the user.

BRIEF SUMMARY OF THE INVENTION

An embodiment of the disclosure meets the needs presented above by generally comprising of a blanket and a suspender. The blanket is configured for wrapping around pants of a user. A strip is coupled along a full length of a top edge of the blanket. The strip is a first portion of a hook and loop fastener, wherein the strip is constructed of a loop material. The suspender comprises of a pair of straps. Each strap of the pair of straps has a front fringe and a back fringe. The suspender is configured for being placed on the shoulders of the user such that the front fringe of each strap is positioned in front of the user and the back fringe of each strap is positioned behind the user. A plurality of strap adjusters is coupled to an associated one of the pair of straps. The plurality of strap adjusters is configured for adjusting the length of each strap of the pair of straps. A plurality of tabs is coupled to the front fringe and to the back fringe of each strap of the pair of straps. Each of the tabs is a second portion of the hook and loop fastener. Each of the tabs has a hook material.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
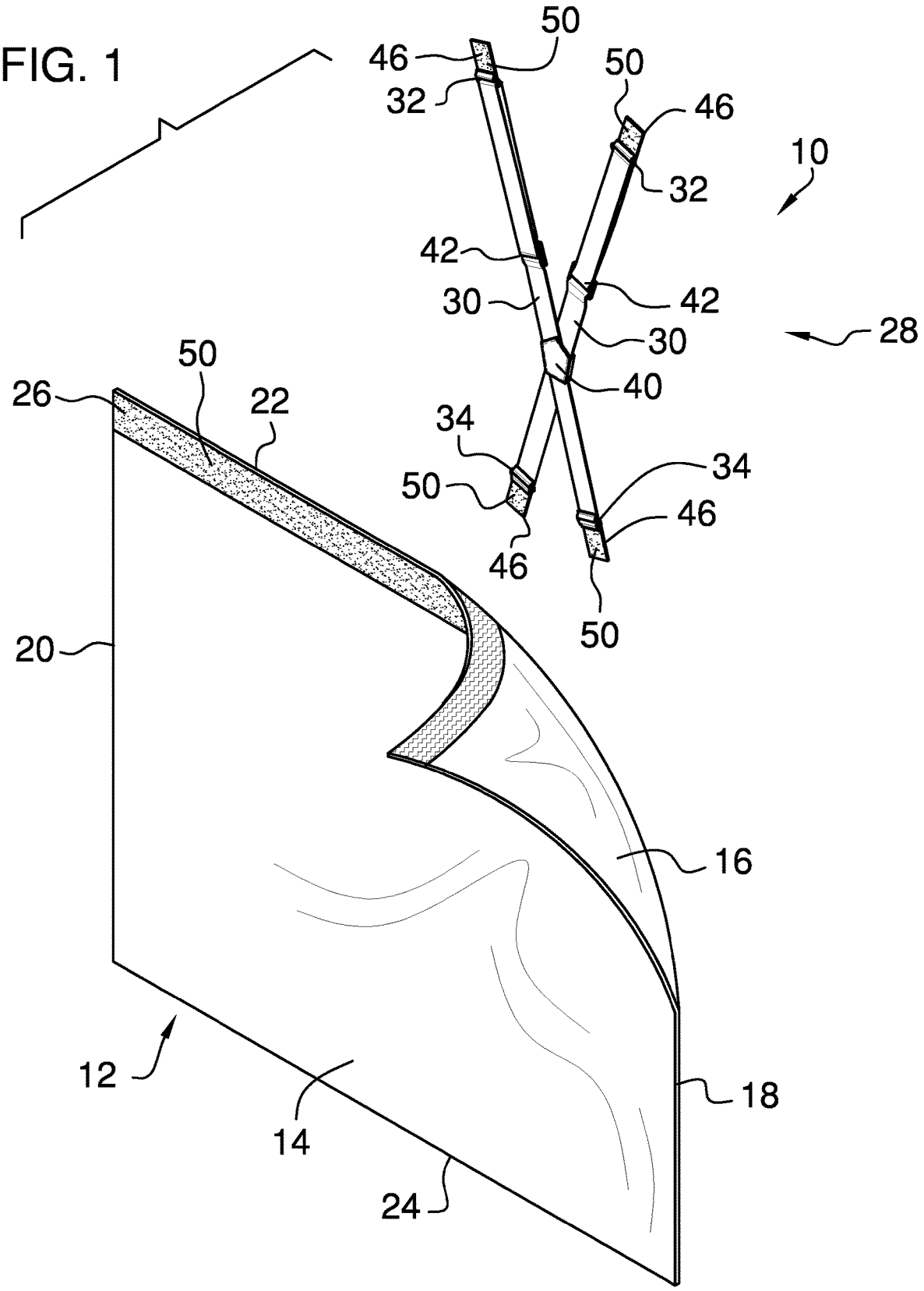
FIG. 1 is an isometric view of a blanket suspender assembly according to an embodiment of the disclosure.

With reference now to the drawings, and in particular to FIGS. 1 through 6 thereof, a new blanket securing system embodying the principles and concepts of an embodiment of the disclosure and generally designated by the reference numeral 10 will be described.

As best illustrated in FIGS. 1 through 6, the blanket suspender assembly 10 generally comprises a blanket 12. The blanket 12 has a front face 14 and a back face 16 as shown in FIG. 1. The blanket 12 has a right edge 18 and a left edge 20. Furthermore, the blanket has a top edge 22 and a bottom edge 24. The right edge 18 and the left edge 20 are positioned parallel to each other. The top edge 22 is positioned perpendicular relative to the right edge 18 and to the left edge 20. Shown in FIG. 1 a strip 26 is coupled along a full length of the top edge 22. The strip 26 is coupled to both the front face 14 and the back face 16 of the blanket 12.

Figure 3:
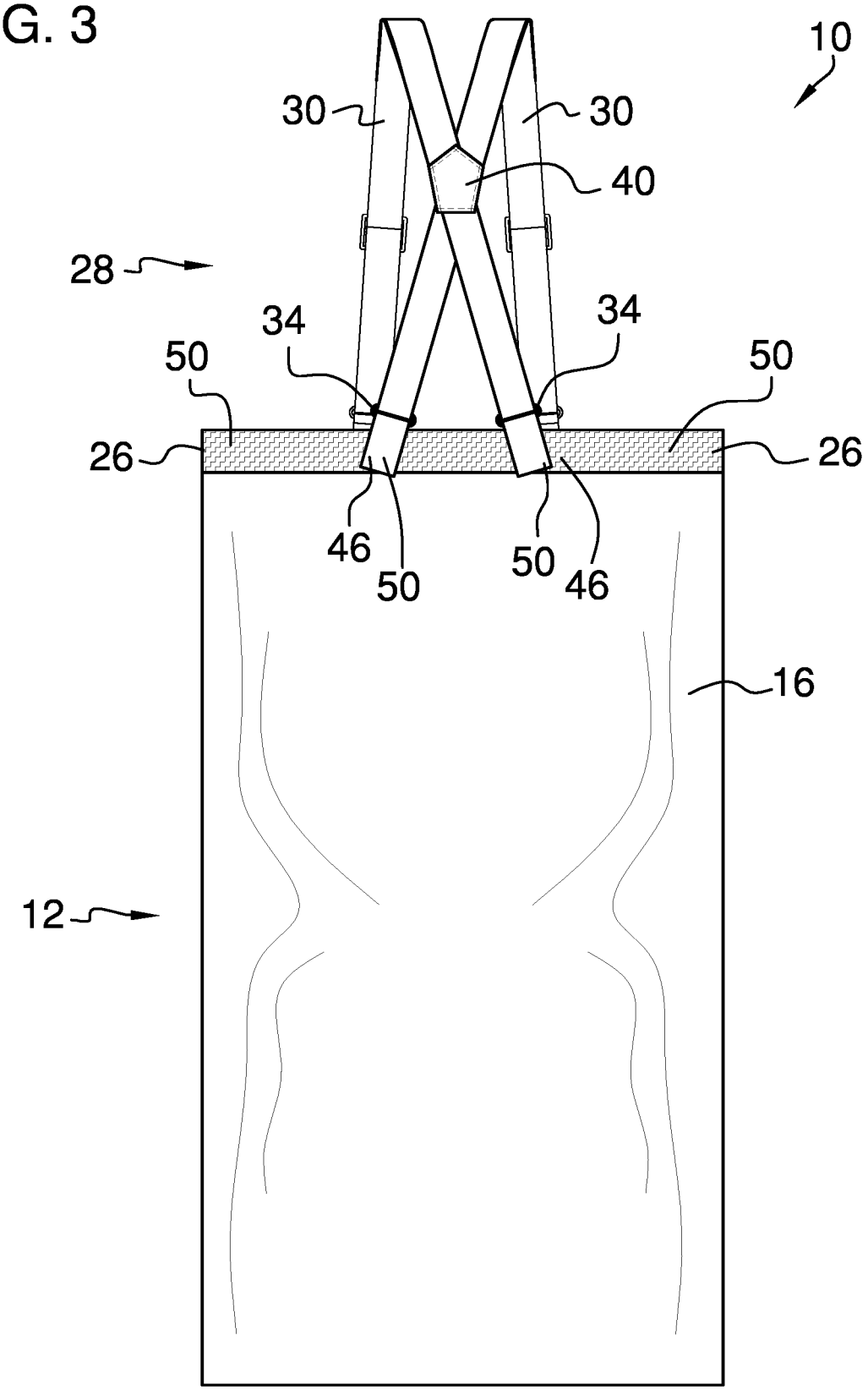
FIG. 3 is a back view of an embodiment of the disclosure.
Figure 4:
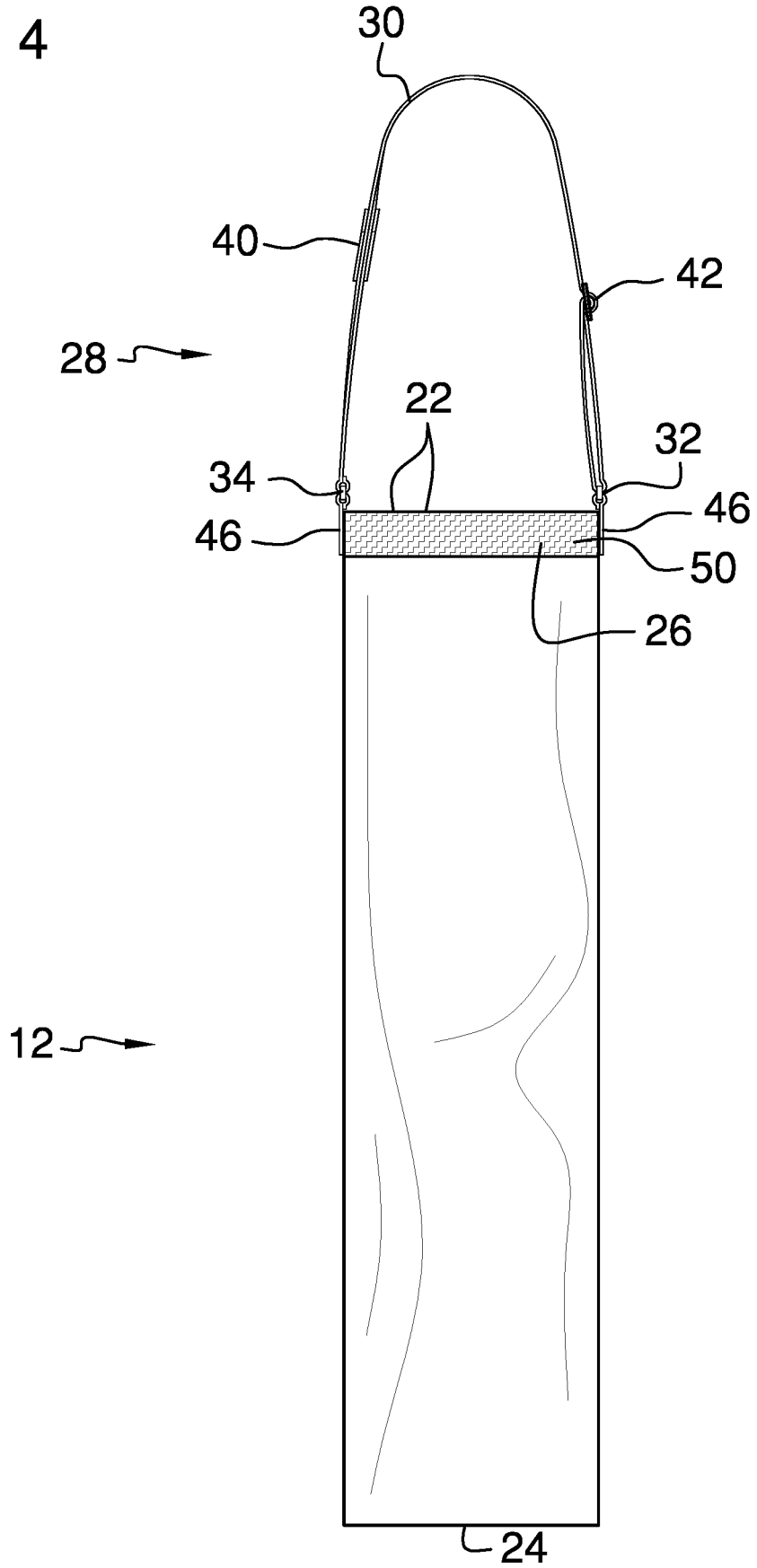
FIG. 4 is a side view of an embodiment of the disclosure.
Figure 5:
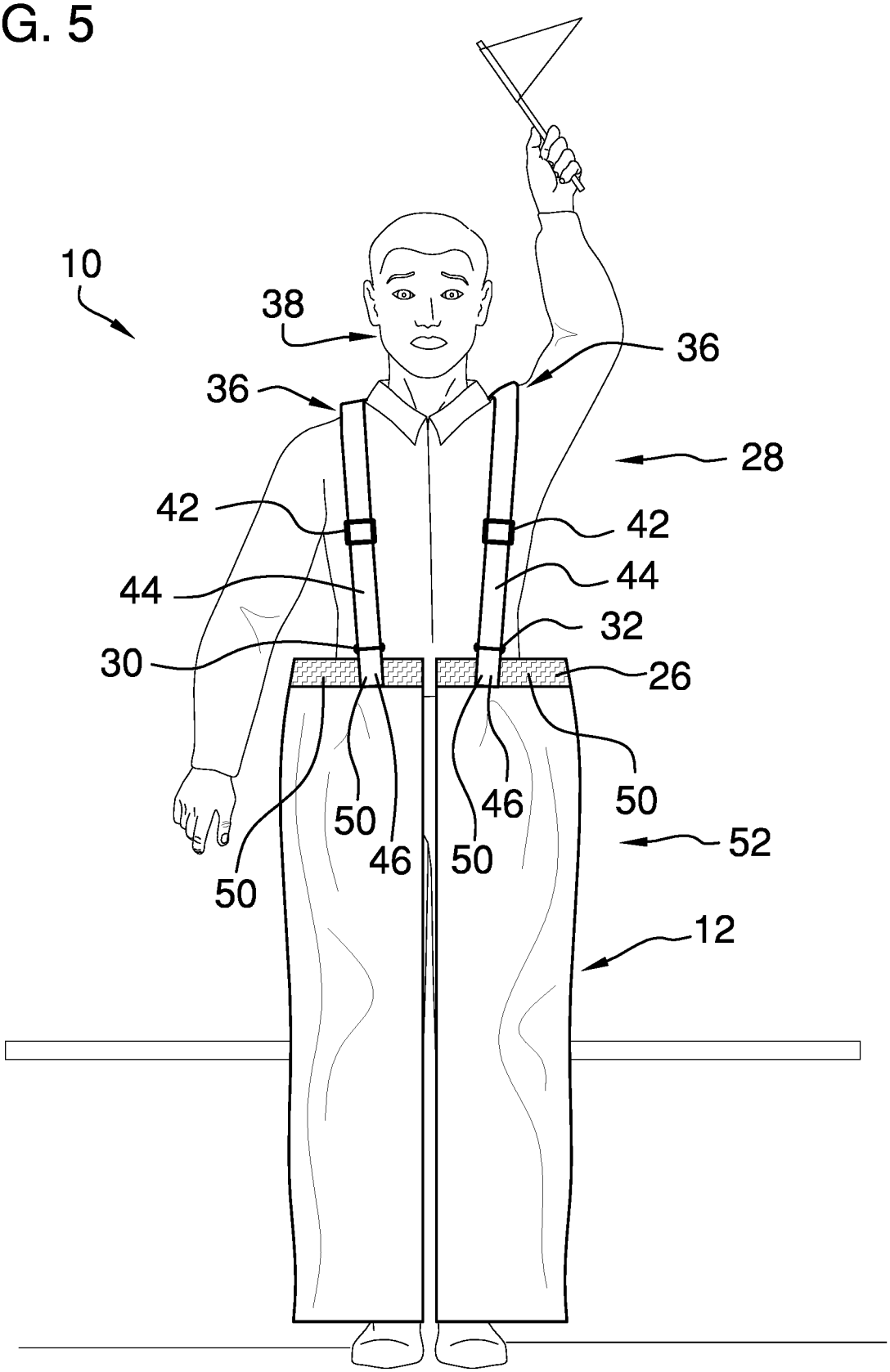
FIG. 5 is a front in-use view of an embodiment of the disclosure.

A suspender 28 comprises of a pair of straps 30. Each of the straps 30 has a front fringe 32 and a back fringe 34. As shown in FIG. 5, the suspender 28 is configured for being placed on the shoulders 36 of a user 38 such that the front hinge 32 of each strap 30 is positioned in front of the user 38 and the back hinge 34 of each strap 30 is positioned behind the user 38. Each of the straps 30 is coupled to each other in a crossing juncture 40. The positioning of the crossing juncture 40 is configured to be behind the user 38 as shown in FIG. 3.

Figure 2:
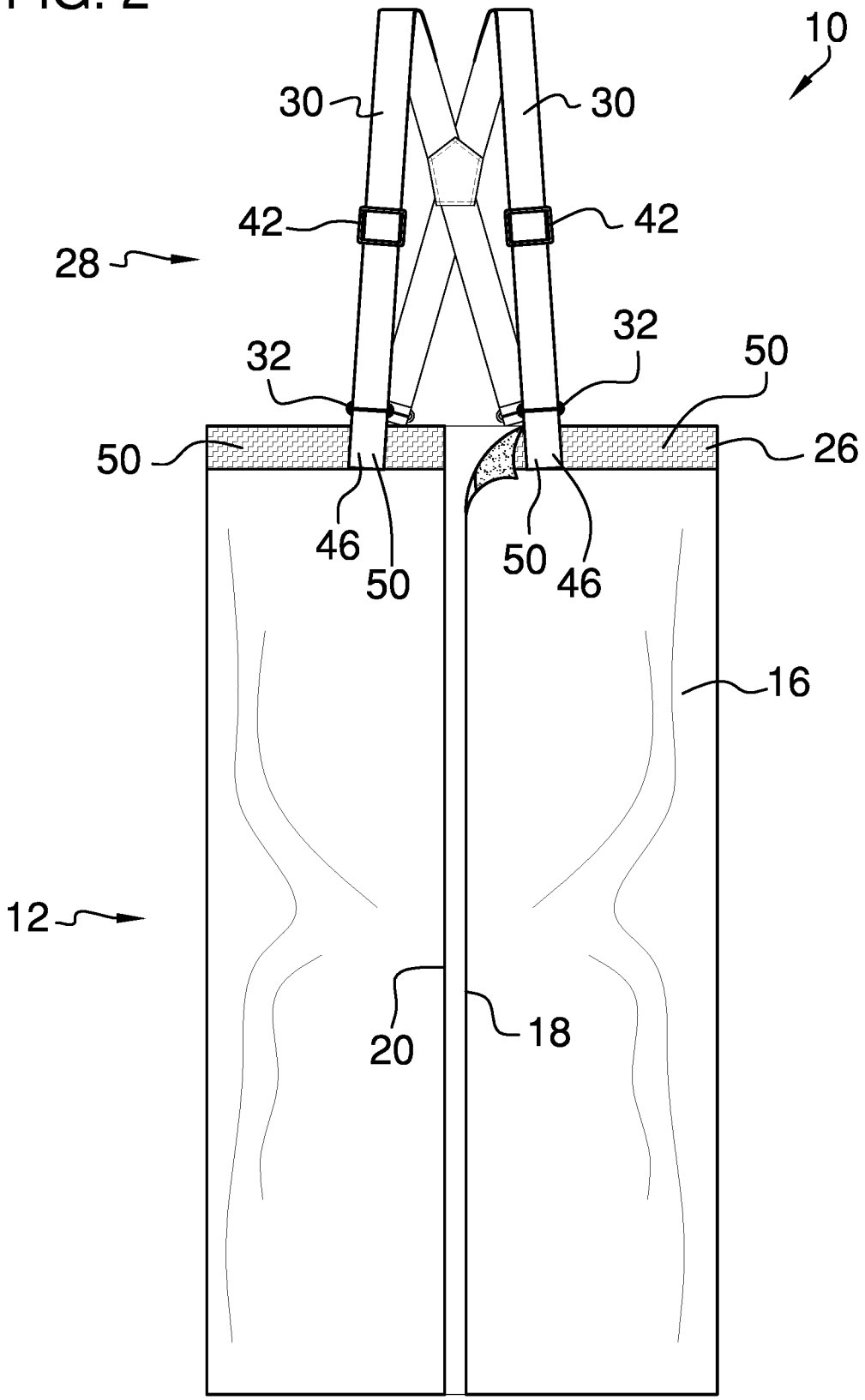
FIG. 2 is a front view of an embodiment of the disclosure.

A plurality of strap adjusters 42 is coupled to an associated one of each of the straps 30. Each of the strap adjusters 42 are configured for being positioned in front of the user 38 as shown in FIG. 2. The plurality of strap adjusters 42 is configured for adjusting the length 44 of each strap 30. A plurality of tabs 46 is coupled to the front hinge 32 and to the back hinge 34 of each strap 30.

Figure 6:
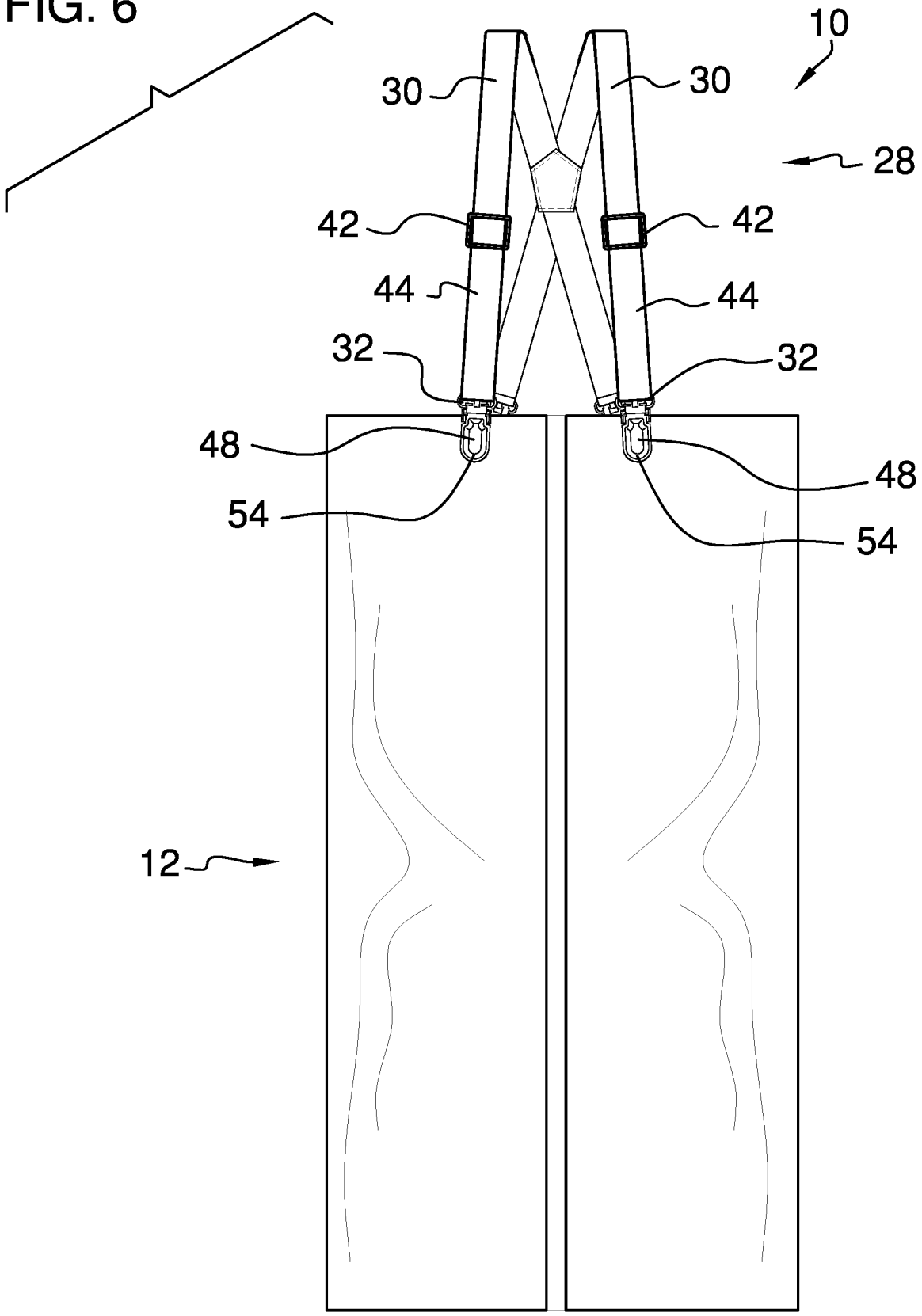
FIG. 6 is an alternative front view of an embodiment of the disclosure.

FIG. 6 shows an alternative embodiment wherein a plurality of suspender clips 48 is coupled to both the front hinge 32 and to the back hinge 34 of each strap 30. In this embodiment, the strip 26 is absent from the blanket 12. Furthermore, the plurality of tabs 46 is removed from the suspender 28.

In use, the blanket 12 and the suspender 28 are configured for engaging by hook and loop fastening 50 with each other. The plurality of tabs 46 of the suspender 28 engages by hook and look fastening 50 with the strip 26 of the blanket 12. The blanket 12 is configured for enwrapping the pants 52 of the user 38 as shown in FIG. 5. The suspender 28 is configured to provide support for the blanket 12 as shown in FIG. 5.

FIG. 6 shows an alternative embodiment wherein the suspender 28 provides support for the blanket 12 by engaging with clamp fastening 54 from the plurality of suspender clips 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. a blanket suspension assembly comprising:

a blanket, said blanket comprising an insulated fabric, said blanket being a rectangular shape, said blanket having a front face and a back face, said blanket having a top edge and a bottom edge, said blanket having a left edge and a right edge, said blanket being configured for wrapping around pants of a user;

a strip, said strip being coupled along a full length of said top edge, said strip being a first portion of a hook and loop fastener;

a suspender, said suspender having of a pair of straps, each strap of said pair of straps having a front fringe and a back fringe, said suspender being configured for being placed on the shoulders of the user such that said front fringe of each strap is positioned in front of the user and said back fringe of each strap is positioned behind the user;

a plurality of strap adjusters, each of said strap adjusters being coupled to an associated one of said pair of straps, said plurality of strap adjusters configured for adjusting the length of each strap of said pair of straps; and a plurality of tabs, each of said tabs being coupled to said front fringe and to said back fringe of each strap of said pair of straps, each of said tabs being a second portion of said hook and loop fastener.

2. The blanket suspension assembly of claim 1, further comprising said left edge and said right edge being parallel relative to each other, said top edge being perpendicular relative to said left edge and to said right edge.

3. The blanket suspension assembly of claim 1, further comprising said strip being coupled to said front face and said back face.

4. The blanket suspension assembly of claim 1, further comprising said first portion being a loop material of said hook and loop fastener.

5. The blanket suspension assembly of claim 1, further comprising said pair of straps being coupled to each other, said pair of straps being coupled in a crossing juncture, said crossing juncture configured for being positioned behind the user.

6. The blanket suspension assembly of claim 1, further comprising said plurality of strap adjusters configured for being positioned in front of the user.

7. The blanket suspension assembly of claim 1, further comprising said second portion being a hook material, said hook material being complementary to said loop material wherein said plurality of tabs is engaged by hook and loop fastening to said strip of said blanket.

8. A blanket suspension assembly comprising:

a blanket, said blanket comprising an insulated fabric, said blanket being a rectangular shape, said blanket having a front face and a back face, said blanket having a top edge and a bottom edge, said blanket having a left edge and a right edge, said left edge and said right edge being parallel relative to each other, said top edge being perpendicular relative to said left edge and to said right edge, said blanket being configured for wrapping around pants of a user;

a strip, said strip being coupled along a full length of said top edge, said strip being coupled to said front face and said back face, said strip being a first portion of a hook and loop fastener, said first portion being a loop material of said hook and loop fastener;

a suspender, said suspender having of a pair of straps, each strap of said pair of straps having a front fringe and a back fringe, said suspender being configured for being placed on the shoulders of the user such that said front fringe of each strap is positioned in front of the user and said back fringe of each strap is positioned behind the user, said pair of straps being coupled to each other, said pair of straps being coupled in a crossing juncture, said crossing juncture configured for being positioned behind the user;

a plurality of strap adjusters, each of said strap adjusters being coupled to an associated one of said pair of straps, said plurality of strap adjusters configured for being positioned in front of the user, said plurality of strap adjusters configured for adjusting the length of each strap of said pair of straps; and a plurality of tabs, each of said tabs being coupled to said front fringe and to said back fringe of each strap of said pair of straps, each of said tabs being a second portion of said hook and loop fastener, said second portion being a hook material, said hook material being complementary to said loop material wherein said plurality of tabs is engaged by hook and loop fastening to said strip of said blanket.

* * * * *